US006454928B1

(12) United States Patent
Takeshita et al.

(10) Patent No.: US 6,454,928 B1
(45) Date of Patent: Sep. 24, 2002

(54) METHOD FOR PREVENTING THE THERMAL OXIDATION YELLOWING OF TIN-PLATED WIRES

(75) Inventors: Yasuo Takeshita, Hyogo-ken (JP); Tomohiro Fujioka, Hyogo-ken (JP); Nobuhiro Miyazawa, Hyogo-ken (JP)

(73) Assignee: Riken Electric Wire Co., Ltd., Tokyo (JP)

( * ) Notice: Subject to any disclaimer, the term of this patent is extended or adjusted under 35 U.S.C. 154(b) by 88 days.

(21) Appl. No.: 09/775,131

(22) Filed: Feb. 1, 2001

(51) Int. Cl.[7] ..... B05D 1/18; C25D 3/60

(52) U.S. Cl. ..... 205/252; 205/140; 427/117; 427/433

(58) Field of Search ..... 205/140, 252, 205/253, 245; 427/117, 433

(56) References Cited

U.S. PATENT DOCUMENTS 4,323,402 A * 4/1982 Tachikawa et al. ..... 148/133
4,341,572 A * 7/1982 Tachikawa et al. ..... 148/11.5 F
5,198,189 A * 3/1993 Booth et al. ..... 420/555
5,514,261 A * 5/1996 Herklotz et al. ..... 205/238

FOREIGN PATENT DOCUMENTS

JP 7-307172 * 11/1995

* cited by examiner

*Primary Examiner*—Nam Nguyen
*Assistant Examiner*—William T. Leader
(74) *Attorney, Agent, or Firm*—Quarles & Brady LLP

(57) ABSTRACT

A method for providing a tin-plated wire which is free from thermal oxidation yellowing. In a tin-plated wire which comprises a core wire 1 with its surface being formed with a tin-plating layer 2, the composition of the plating is comprised of 30 to 500 wppm gallium, and tin or tin alloy that makes up the remainder thereof. With the content of Ga more than 30 wppm, thermal yellowing is able to be prevented. As too much content of Ga causes surface roughness, the content of Ga must be 500 wppm or below.

14 Claims, 2 Drawing Sheets

METHOD FOR PREVENTING THE THERMAL OXIDATION YELLOWING OF TIN-PLATED WIRES

BACKGROUND OF THE INVENTION

1. Field of the Invention

The present invention relates to a tin-plated wire, particularly to a method for preventing the thermal oxidation yellowing thereof.

2. Prior Art

Conventional tin-plated wires have had a problem that they turn yellow due to oxide films produced by high temperature heating process to which they are subjected when they are being processed into wires for electronic components.

SUMMARY OF THE INVENTION

To eliminate the above-mentioned problems, the inventors of the present invention have studied the problem of such thermal oxidation yellowing of the tin-plating layer, through experiments by adding various kinds of metals to the tin-plating composition.

Therefore, it is an object of the invention to provide a method for preventing thermal oxidation yellowing of tin-plated wires.

It is another object of the invention to provide a tin-plated wire which is free from thermal oxidation yellowing caused by high temperature heating process.

In accordance with a first aspect of the invention, there is provided a method for preventing the thermal oxidation yellowing of a tin-plated wire, said wire comprising a core wire and a tin-plating layer formed on a surface of the core wire, wherein the tin-plating composition includes 30 to 500 ppm by weight of gallium, while the remainder thereof is tin or tin alloy.

In accordance with a second aspect of the invention, there is provided a method as set forth in the first aspect of the invention, wherein said tin alloy includes at least 0.5 to 5 percent by weight of copper, while the remainder thereof is tin.

In the case that the remainder is comprised of tin only, it has been found that no yellowing has occurred due to the oxide film produced by the heating of one hour at 210 degrees centigrade.

Further, in the case that the remainder is comprised of tin-copper alloy including 2.5 percent by weight of copper, in order to improve the properties of wires for electronic components and to lower a melting point thereof, it has also been found that no yellowing has occurred due to the oxide film produced by the heating of one hour at 210 degrees centigrade.

It should be noted that if the content of gallium is less than 30 wppm, then the effect for preventing the oxidation yellowing is diminished, while if it is more than 500 wppm, then the surface of the plating is roughened and thus its appearance is impaired. Accordingly, the desirable content of the gallium is in a range of from 30 wppm to 500 wppm.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DESCRIPTION OF PREFERRED EMBODIMENTS

Hereinafter are described preferred embodiments of the present invention with reference to the attached drawings.

Figure 1:
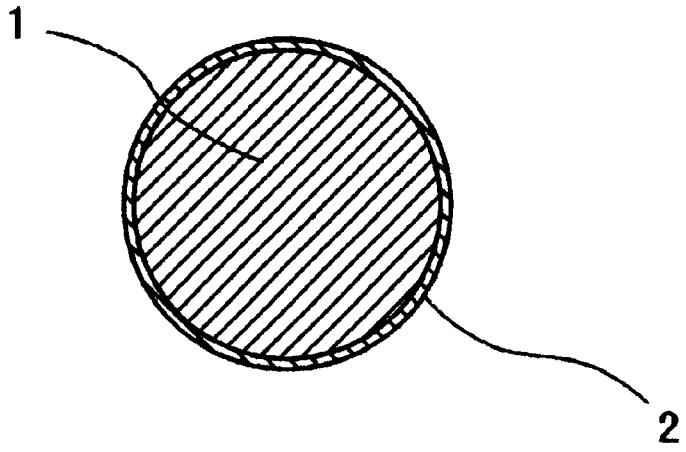
FIG. 1 is a section of a tin-plated wire in accordance with an embodiment of the invention.

As shown in FIG. 1, a tin-plated wire comprises a core wire 1 and a tin-plating layer 2 formed on the surface of the core wire 1. The core wire 1 is formed of a conductive material, such as copper, which however should not be limited to copper, but may be other materials such as a steel wire with its surface plated with copper.

The tin-plating layer 2 includes 30 wppm (0.003 w %) to 500 wppm(0.05 w %) of gallium, with the remainder being either tin or tin alloy. In a preferred form of the invention, the tin may include 2.5 w % (percent by weight of) copper, to thereby improve properties required for a wire for electronic components, and to lower the melting point thereof. The content of gallium is, more preferably, in a range of from 90 wppm (0.009 w %) to 300 wppm(0.03 w %).

Figure 2:
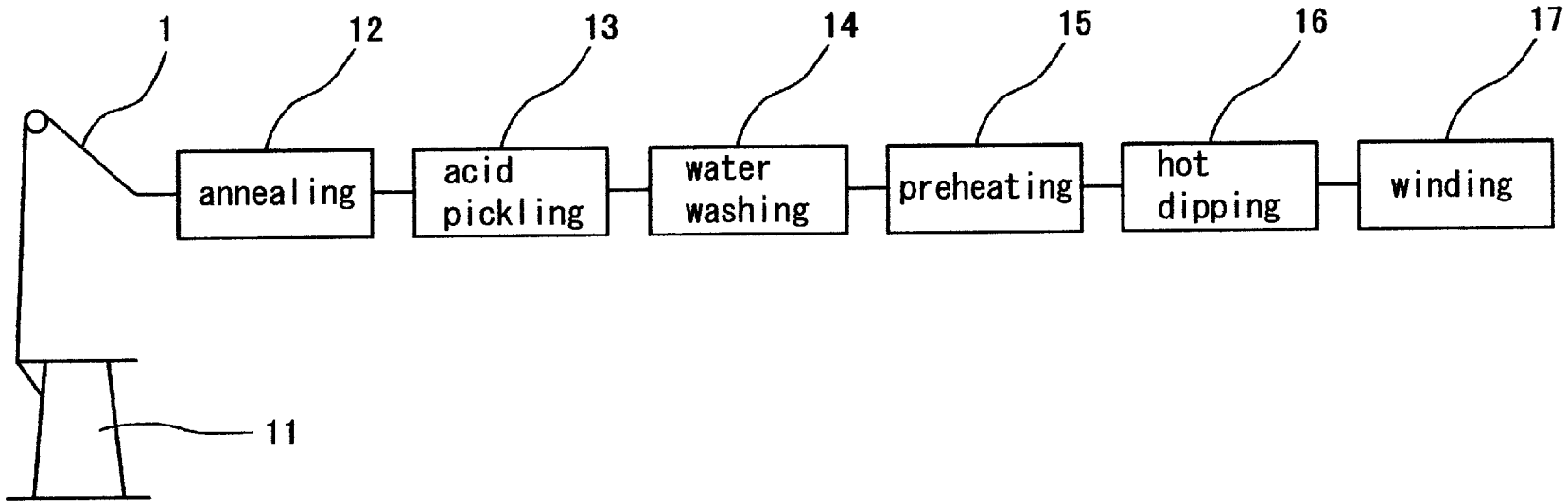
FIG. 2 is an explanatory diagram showing a method for manufacturing a tin-plated wire of FIG. 1.

Next, a schematic plating process for forming the tin-plating layer 2 is explained with reference to FIG. 2, in which reference numeral 11 designates a feeder device such as a bobbin, 12 designates an annealer, 13 an acid pickling device, 14 a water washing device, 15 a preheater, 16 a hot dipping device and 17 a winding device, respectively.

The core wire 1 is fed from the feeder device 11, which is first annealed by the annealer 12 at about 500 degrees centigrade, then it is subjected to the acid pickling, using pickling agent, then subjected to a water washing process by the water washing device 14. Next, the core wire 1 is preliminarily heated at about 500 degrees centigrade by the preheater 15. During this preheating process, nitrogen gas seal is carried out to prevent the oxidation thereof The core wire 1 is then subjected to the hot dipping to thereby form the tin-plating layer 2. The hot dipping is carried out by dipping the core wire 1 in the fused plating metal. The wire thus formed with the tin-plating layer is then wound by the winding device 17.

As shown by actual data in hereinbelow-described preferred embodiments of the invention, it has been found that if the plating composition is 30 to 500 wppm gallium and either tin or tin alloy that includes 2.5 w % copper, then no oxidation yellowing takes place even under the heating for one hour at 210 degrees centigrade.

Next, some examples of the tin-plated wires according to the invention will be explained in detail. The core wire 1 used here was made of copper, having a diameter of wire about 0.6 mm. The plating process was shown in FIG. 2 as described in the foregoing, in which, however, the take-up speed of the core wire 1 was 28 m/min. Further, the temperature for hot dipping was set to 300 degrees centigrade, while the plating thickness was set to 8 $\mu$m.

By changing the composition (1) of the plating bath, the tin-plated wires thus obtained were evaluated from a viewpoint of the external appearance of a wire after the heating for one hour at 210 degrees centigrade, particularly from viewpoints of the degree of the yellowing (2) and the surface roughness (3) thereof. In the following tables 1 to 3 showing the results obtained, a small circle symbol "○" indicates "good" or superior, a delta symbol "Δ" indicates "not bad"(but not so good), while a cross symbol "×" indicates "bad" or inferior, respectively. The composition of the plating bath was as shown in each table, in which sample Nos. 5 to 10 correspond to the embodiments according to the present invention, whilst sample Nos. 1 to 4, and Nos. 11 and 12 are comparative examples.

TABLE 1

| | Sample 1 | Sample 2 | Sample 3 | Sample 4 |
|---|---|---|---|---|
| (1) the composition of plating bath | Sn 100% | Sn 97.5% Cu 2.5% | Sn 100% Ga less than 30 wppm | Sn 97.5% Cu 2.5% Ga less than 30 wppm |
| (2)yellowing of appearance | x | x | x | x |
| (3) surface roughness | ○ | ○ | ○ | ○ |

TABLE 2

| | Sample 5 | Sample 6 | Sample 7 | Sample 8 |
|---|---|---|---|---|
| (1) the composition of plating bath | Sn 100% Ga 30 wppm | Sn 97.5% Cu 2.5% Ga 30 wppm | Sn 100% Ga 90–300 wppm | Sn 97.5% Cu 2.5% Ga 90–300 wppm |
| (2)yellowing of appearance | Δ | Δ | ○ | ○ |
| (3) surface roughness | ○ | ○ | ○ | ○ |

TABLE 3

| | Sample 9 | Sample 10 | Sample 11 | Sample 12 |
|---|---|---|---|---|
| (1) the composition of plating bath | Sn 100% Ga 500 wppm | Sn 97.5% Cu 2.5% Ga 500 wppm | Sn 100% Ga more than 500 wppm | Sn 97.5% Cu 2.5% Ga more than 500 wppm |
| (2)yellowing of appearance | ○ | ○ | ○ | ○ |
| (3) surface roughness | Δ | Δ | x | x |

As can be seen from the tables 1–3, for the wires of the sample Nos. 1 and 2 in which the plating bath was gallium-free and comprised of either 100% tin or tin-copper alloy of 97.5% tin and 2.5% Cu, and for the wires of the sample Nos. 3 and 4 in which the plating bath included the content of gallium less than 30 wppm, the yellowing of the external appearance occurred due to the heating. On the other hand, for the wires of the sample Nos. 11 and 12 in which the plating bath included the content of gallium more than 500 wppm, no yellowing of the external appearance was found, but the surface roughness was noticeable. Accordingly, it was found that the content of gallium be preferably in a range of from 30 wppm to 500 wppm, more preferably in a range of from 90 wppm to 300 wppm (as shown in the sample Nos. 7 and 8).

Incidentally, the present invention should not be limited to the foregoing embodiments, but may be variously modified within a scope of the invention. For example, although the tin-plated layer was formed by hot dipping in the foregoing embodiments, other methods, such as electroplating or thermal reflow after the electroplating may be used to form the tin-plated layer.

What is claimed is:

1. A method for preventing thermal oxidation yellowing of a tin-plated wire, said tin-plated wire comprising a core wire and a tin-plating layer format on a surface of the core wire, the method comprising:

plating the surface of the core wire with a tin-plating composition which includes: 30 to 500 ppm by weight of gallium; 0.5 to 5 percent by weight of copper; and tin and unavoidable impurities as to the remainder thereof.

2. A method for preventing thermal oxidation yellowing of a tin-plated wire according to claim 1, wherein the content of gallium in said tin-plating layer is 90 to 300 ppm by weight.

3. A method for preventing thermal oxidation yellowing of a tin-plated wire according to claim 2, wherein said core wire is a copper lead.

4. A method for preventing thermal oxidation yellowing of a tin-plated wire according to claim 2, wherein said core wire is a steel lead whose surface is plated with copper.

5. A method for preventing thermal oxidation yellowing of a tin-plated wire according to claim 2, wherein said tin-plated wire is a lead for electronic components.

6. A method for preventing thermal oxidation yellowing of a tin-plated wire according to claim 1, wherein said tin-plating layer is formed by hot dipping.

7. A method for preventing thermal oxidation yellowing of a tin-plated wire according to claim 1, wherein said tin-plating layer if formed by electroplating.

8. A method for preventing thermal oxidation yellowing of a tin-plated wire, said tin-plated wire comprising a core wire and a tin-plating layer formed on a surface of the core wire, the method comprising:

plating the surface of the core wire with a tin-plating composition which includes 30 to 500 ppm by weight of gallium; and tin and unavoidable impurities as to the remainder thereof.

9. A method for preventing thermal oxidation of a tin-plated wire according to claim 8, wherein the content of gallium in said tin-plating layer is 90 to 300 ppm by weight.

10. A method for preventing thermal oxidation yellowing of a tin-plated wire according to claim 9, wherein said core wire is a copper lead.

11. A method for preventing thermal oxidation yellowing of a tin-plated wire according to claim 9, wherein said core wire is a steel lead whose surface is plated with copper.

12. A method for preventing thermal oxidation yellowing of a tin-plated wire according to claim 9, wherein said tin-plated wire is a lead for electronic components.

13. A method for preventing thermal, oxidation yellowing of a tin-plated wire according to claim 8, wherein said tin-plating layer is formed by hot dipping.

14. A method for preventing thermal oxidation yellowing of a tin-plated wire according to claim 8, wherein said tin-plating layer is formed by electroplating.

* * * * *